US005652960A

United States Patent [19]

Kaknevicius

[11] Patent Number: 5,652,960

[45] Date of Patent: Aug. 5, 1997

[54] NURSING AND STROLLER COVER

[76] Inventor: Jurate T. Kaknevicius, 1198 Trotwood Blvd., Winter Springs, Fla. 32708

[21] Appl. No.: 632,950

[22] Filed: Apr. 16, 1996

[51] Int. Cl.[6] ..... A41B 13/10

[52] U.S. Cl. ..... 2/104; 2/69; 297/184.11

[58] Field of Search ..... 297/184.1, 184.11, 297/184.12, 184.13; 2/69, 89, 104, 207; 5/486, 495

[56] References Cited

U.S. PATENT DOCUMENTS

| | | | |
|---|---|---|---|
| 4,072,345 | 2/1978 | Matsuda | 297/184.1 X |
| 4,106,122 | 8/1978 | Dodd . | |
| 4,567,611 | 2/1986 | Kendrick . | |
| 4,631,754 | 12/1986 | Ryan . | |
| 4,651,349 | 3/1987 | Heiler . | |
| 4,712,251 | 12/1987 | Cobble . | |
| 4,797,953 | 1/1989 | Dameron . | |
| 4,924,528 | 5/1990 | Trombetti-Dickens . | |
| 4,964,172 | 10/1990 | Bollard . | |
| 4,989,268 | 2/1991 | Stolhand . | |
| 4,995,116 | 2/1991 | Beauchamp et al. . | |
| 5,034,999 | 7/1991 | Lubbers | 2/104 |
| 5,038,411 | 8/1991 | St. Armand . | |
| 5,042,090 | 8/1991 | Cook . | |
| 5,133,085 | 7/1992 | de Pasquale Amicarelli et al. . | |
| 5,259,068 | 11/1993 | Carroll . | |
| 5,459,877 | 10/1995 | Roberti | 2/104 |
| 5,522,639 | 6/1996 | Jaime | 297/184.11 X |

*Primary Examiner*—Amy B. Vanatta
*Assistant Examiner*—Shirra L. Jenkins
*Attorney, Agent, or Firm*—Allen, Dyer, Doppelt, Milbrath & Gilchrist, P.A.

[57] ABSTRACT

The nursing cover includes a fabric panel that has three portions. The front portion is for draping over a nursing baby and over the front of a nursing mother. The rear portion drapes over the shoulder and down the mother's back. The central portion is made of a mesh-type fabric that has sufficient opacity to obscure the baby from the view of a bystander but sufficient openness of weave to permit ventilation for the baby. Two areas of the outer side edge may be joined to provide additional privacy for the baby and the mother along the nursing side of the mother. When not being used as a nursing cover, it can serve as a stroller cover, with complementary hook-and-loop-type fasteners being mated to form a sleeve that can be draped over a stroller brace. In this embodiment the mesh-type fabric protects the baby from direct sunlight and provides privacy.

9 Claims, 2 Drawing Sheets

NURSING AND STROLLER COVER

BACKGROUND OF THE INVENTION

1. Field of the Invention

The present invention relates to devices for protecting the privacy of a nursing mother, and, more particularly, to a cover that envelops the infant while nursing and that can also be used as a stroller cover.

2. Description of Related Art

Two challenges face nursing mothers who wish to take their infants out of the house: that of being able to nurse discretely and that of protecting the baby from the elements both while nursing and in a stroller. In the past, a receiving blanket has been draped over the baby and the shoulder to provide privacy; however, under these conditions the baby may not receive adequate air flow.

A number of patents have addressed the privacy issue, including those issued to Dodd (U.S. Pat. No. 4,106,122), Kendrick (U.S. Pat. No. 4,567,611), Ryan (U.S. Pat. No. 4,631,754), Heiler (U.S. Pat. No. 4,651,349), Cobble (U.S. Pat. No. 4,712,251), Dameron (U.S. Pat. No. 4,797,953), Trombetti-Dickens (U.S. Pat. No. 4,924,528), Bollard (U.S. Pat. No. 4,964,172), Stolhand (U.S. Pat. No. 4,989,268), Beauchamp et al. (U.S. Pat. No. 4,995,116), St. Armand (U.S. Pat. No. 5,038,411), Cook (U.S. Pat. No. 5,042,090), de Pasquale Amicarelli et al. (U.S. Pat. No. 5,133,085), and Carroll (U.S. Pat. No. 5,259,068).

It is believed, however, that the previously disclosed devices provide inadequate ventilation for the infant, inhibit the mother's mobility, are complicated to assemble and expensive to manufacture, and are uncomfortable and/or unwieldy.

SUMMARY OF THE INVENTION

It is therefore an object of the present invention to provide a cover that permits adequate ventilation for the baby during nursing.

It is an additional object to provide such a cover that permits the mother to view the infant's face during nursing.

It is a further object to provide such a cover that allows the mother improved mobility during nursing.

It is another object to provide such a cover that is easy to use and inexpensive to manufacture.

It is yet an additional object to provide such a cover that is comfortable to use.

It is yet a further object to provide such a cover that can also be used as a stroller cover to protect the infant from the elements and yet permit adequate ventilation.

These and other objects are achieved by the nursing and stroller cover of the present invention. The nursing cover comprises a fabric panel that has three portions. A front portion is for draping over a nursing baby and over the front of a nursing mother. A rear portion is for draping over the shoulder and down the mother's back. The rear portion has an outer side edge corresponding to the side on which the mother is nursing. Front and rear portions are made of soft fabric for minimizing irritation to the baby and mother.

The central portion of the fabric panel has a bottom edge connected to the front portion and a top edge connected to the rear portion. Preferably the central portion comprises a mesh-type or open-weave fabric that has sufficient opacity to obscure the baby from the view of a bystander but sufficient openness of weave to permit ventilation for the baby. The length of the central portion further is defined by the distance between the bottom edge and the top edge, and should preferably be commensurate with or greater than the length of a baby's head. The outer side edge is along the same side as the rear portion's outer side edge, and an inner side edge is generally opposed thereto.

Means are provided for detachably affixing together a first area of fabric adjacent the outer side edge of the central portion to a second area of fabric adjacent the outer side edge of the rear portion. This permits a joining of the side edges and provides additional privacy for the baby and the mother along the nursing side of the mother.

When the cover is not being used as a nursing cover, it can double as a stroller cover. In this embodiment, additional affixing means are provided for means for detachably affixing together two analogous areas of fabric on the inner side edges of the central portion and the rear portion. These two affixing means can thus be used to create a sleeve that can be draped over a stroller brace. In this embodiment the mesh-type fabric again serves the purpose of permitting ventilation for the baby but protects the baby from direct sunlight and provides privacy.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
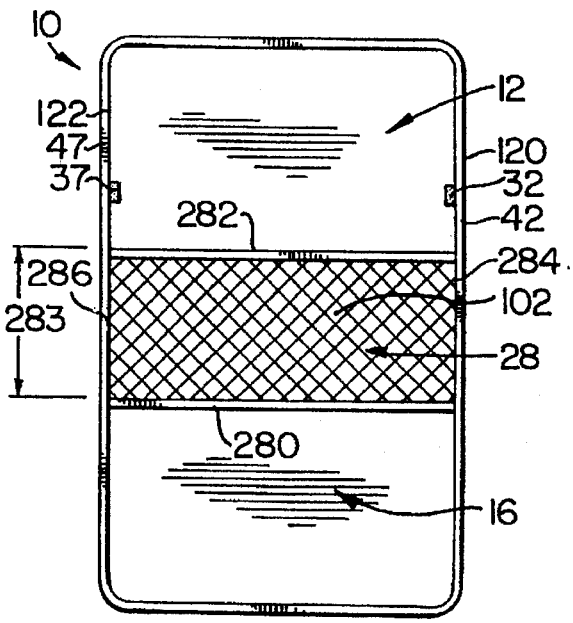
FIG. 1 is a view of the outer face of the nursing and stroller cover.
Figure 2:
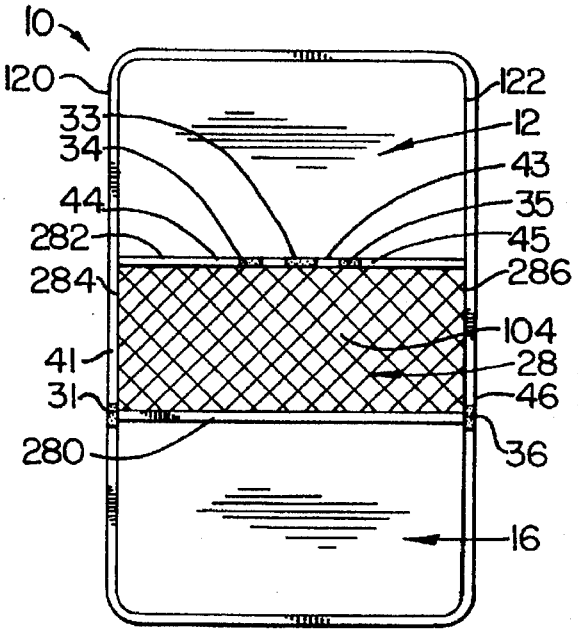
FIG. 2 is a view of the inner face of the nursing and stroller cover.
Figure 3:
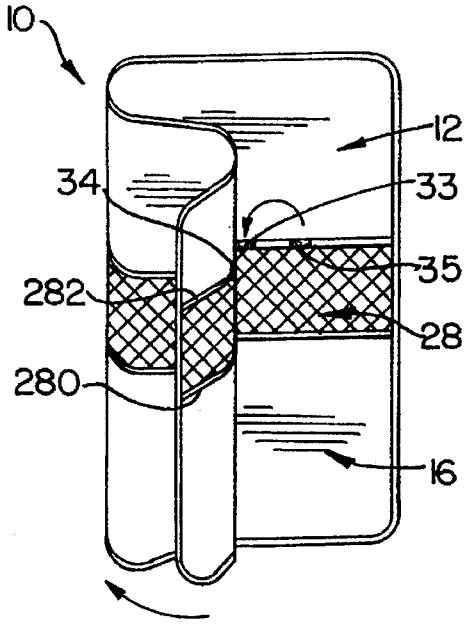
FIG. 3 illustrates the creation of a tent-like fold for the baby's head.
Figure 4:
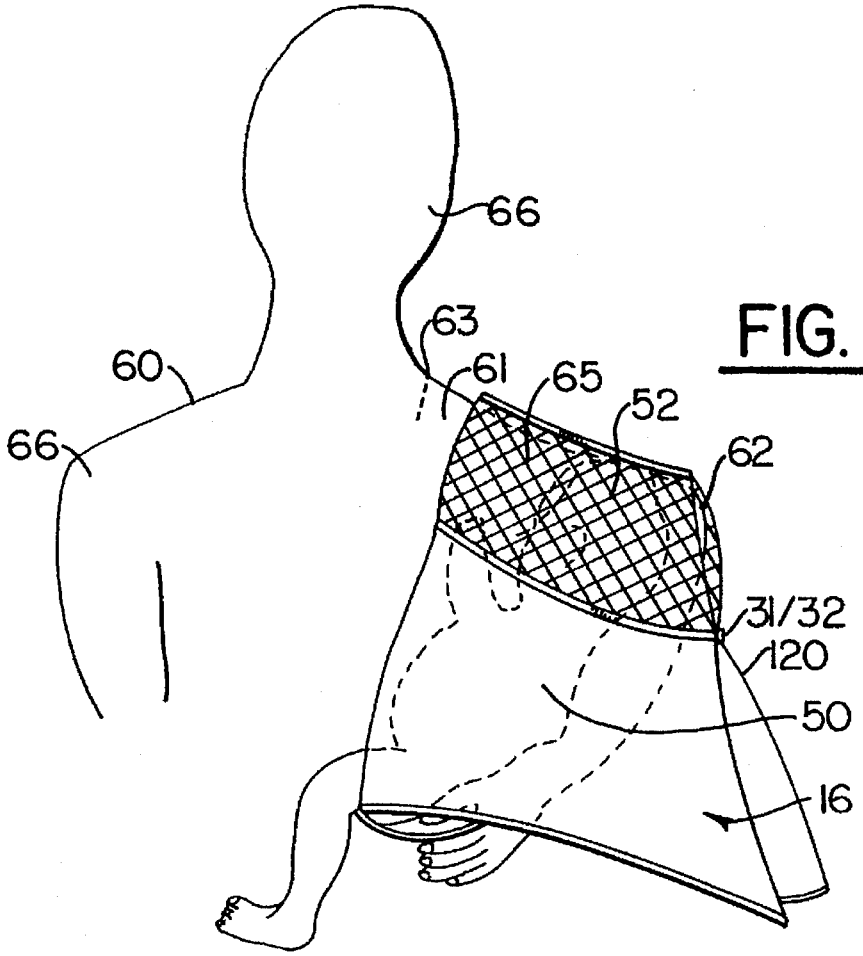
FIG. 4 is a perspective view of the nursing cover positioned over the mother's shoulder.

A description of the preferred embodiments of the present invention will now be presented with reference to FIGS. 1–5.

The Nursing Cover

The nursing cover 10 of the present invention, illustrated in FIGS. 1–4, comprises a generally rectangular fabric panel having three portions.

The front portion 16 is for draping over a nursing baby 50 and over the front 61 of a mother 60 to provide privacy during nursing. The rear portion 12 is for draping over the mother's shoulder 62 and down her back 63. The rear portion 12 has an outer side edge 120 that corresponds to the side on which the mother 60 is nursing and an inner side edge 122 that is generally opposite the outer side edge 120. Both the front portion 16 and the rear portion 12 are preferably made of a soft fabric in order to maximize comfort and minimize irritation to the baby 50 and the mother 60.

The generally central portion 28 has a bottom edge 280 that is sewn to the top of the front portion 16 and a top edge 282 that is sewn to the bottom of the rear portion 12. The central portion 28 comprises a mesh fabric that has sufficient opacity to obscure the baby 50 from the view of a bystander but has sufficient openness of weave to permit ventilation for the baby 50. Preferably the mesh fabric further has sufficient openness of weave to permit the baby 50 to be viewed from a distance corresponding to the distance between the mother's head 66 and the nursing baby 50. This feature permits the mother 60 to watch the baby 50 while at the same time having privacy for herself and the baby 50 from bystanders.

The central portion 28 further has a length 283 that is defined by the distance between the bottom edge 280 and the top edge 282, which typically should be at least sufficient to encompass the baby's head 52. The outer side edge 284 is along the same side as the rear portion's outer side edge 120, and the inner side edge 286 is generally opposed to the outer side edge 284.

Means are also included for providing additional privacy for the baby 50 and the mother 60 along the mother's nursing side 65. Velcro™ hook-and-loop-type fasteners are used to detachably affix together a first area of fabric adjacent the outer side edge 284 of the central portion 28 to a second area of fabric adjacent the outer side edge 120 of the rear portion 12. These fasteners serve to close the sides of the draped nursing cover 10 along the mother's arm and below her shoulder.

Specifically, a first section 31 of hook-and-loop-type fastener is affixed to the first area of fabric 41, which is adjacent the central portion's bottom edge 280, on the cover's inner face 104, and adjacent the outer side edge 284.

A second section 32 of hook-and-loop-type fastener, which is matable with the first section 31, is affixed to the second area of fabric 42, which is on the cover's outer face 102, adjacent the outer side edge 120 and in spaced relation to the central portion's top edge 282.

In a preferred embodiment, means are also included for providing additional privacy for the baby 50 and the mother 60 when the mother 60 wishes to nurse on the opposite side 66. Thus an analogous means is for detachably affixing together a sixth area 46 of fabric adjacent the inner side edge 286 of the central portion 28 to a seventh area 47 of fabric adjacent the inner side edge 122 of the rear portion 12.

As previously, this is accomplished with Velcro™ hook-and-loop-type fasteners. A sixth section 36 of hook-and-loop-type fastener is affixed to the sixth area of fabric 46, which is adjacent the central portion's bottom edge 280, on the cover's inner face 104, and adjacent the inner side edge 286.

A seventh section 37 of hook-and-loop-type fastener, which is matable with the sixth section 36, is affixed to the seventh area of fabric 47, which is on the cover's outer face 102, adjacent the inner side edge 122 and in spaced relation to the central portion's top edge 282.

Preferably these two sets of fasteners 31/32 and 36/37 are generally symmetrically positioned on the cover 10, with fastener 31 laterally opposite fastener 36 and fastener 32 laterally opposite fastener 37, although this is not meant to be limiting.

The nursing cover of the present invention further comprises a means for creating a tented area within the central portion 28 to provide additional space for the baby's head 52. This is accomplished by including means for detachably affixing a third area 43 of fabric generally along a central section 283 of the central portion top edge 282 to two other areas of fabric, namely, (1) a fourth area 44 along the central portion top edge 282 between the third area 43 of fabric and the outer side edge 284 and (2) a fifth area 45 of fabric along the central portion top edge 282 between the third area of fabric 43 and the inner side edge 286.

As previously, this may be accomplished with the use of Velcro™ hook-and-loop-type fasteners, a first section 33 of which is affixed to the third area 43 of fabric. The matable second sections 34 and 35 are affixed, respectively, to the fourth 44 and the fifth 45 areas of fabric. The first section 33 is dimensioned to permit the attachment of the two second sections 34,35 simultaneously, which creates a fold of material above the baby's head 52 (see FIGS. 3 and 4). All three sections of hook-and-loop-type fastener 33-35 are affixed to the cover's inner face 104.

It can be seen that the nursing cover of the present invention permits mobility of the mother's hands and arms during nursing, is designed to stay in place during nursing even if the mother and/or baby are moving, is less conspicuous than previously disclosed designs, has no cumbersome hardware, is inexpensive to manufacture, and is compact and easy to carry.

The Stroller Cover

The cover 10 described above can also be used as a stroller or bassinet cover when the stroller or bassinet 70 has an upwardly protruding brace member 72. As is shown in FIG. 5, the first 31 and the second 32 fasteners are affixed together to form a first side of a sleeve and the sixth 36 and the seventh 37 fasteners, when affixed together, form a second side of a sleeve and thus form the enclosed sectors of the rear 12 and central 28 portions into a sleeve 38 that can be slipped over the brace 72, leaving the central portion 28 to act as a shield against the elements and as a privacy screen, while at the same time permitting adequate ventilation for the baby 50.

Figure 5:
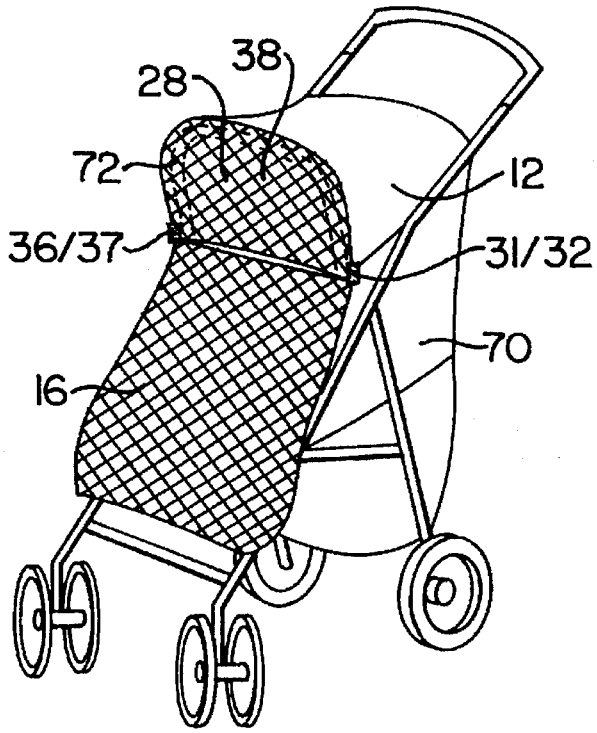
FIG. 5 is a perspective view of the stroller cover embodiment.

In an alternate embodiment, as shown in FIG. 5, bottom portion 16 also comprises a mesh-type fabric, which increases the ventilation aspect of the cover.

It may be appreciated by one skilled in the art that additional embodiments may be contemplated, including the use of the cover for other purposes, for example, as a burping blanket or a car seat cover.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A nursing cover comprising:

a fabric panel having:

a front portion for draping over a nursing baby and over a front of a nursing mother;

a rear portion for draping over a shoulder and down a back of the nursing mother, the rear portion having an outer side edge corresponding to a nursing side of the mother; and a generally central portion having a bottom edge connected to the front portion and a top edge connected to the rear portion, the central portion comprising a mesh fabric having sufficient opacity to obscure the baby from a view of a bystander but having sufficient openness of weave to permit ventilation for the baby, the central portion further having a length defined by a distance between the bottom edge and the top edge, an outer side edge along a same side as the rear portion outer side edge, and an inner side edge generally opposed to the outer side edge; and means for detachably affixing together a first area of fabric adjacent the outer side edge of the central portion to a second area of fabric adjacent the outer side edge of the rear portion, for providing additional privacy for the baby and the mother along the nursing side of the mother.

2. The nursing cover recited in claim 1, wherein the affixing means comprises:

a first section of hook-and-loop-type fastener affixed adjacent the central portion bottom edge and adjacent the outer side edge thereof; and a second section of hook-and-loop-type fastener matable with the first section of hook-and-loop-type fastener and affixed to the rear portion adjacent the outer side edge thereof and in spaced relation to the central portion top edge.

3. The nursing cover recited in claim 1, further comprising means for creating a tented area within the central portion to provide additional space for a head of the baby.

4. The nursing cover recited in claim 3, wherein the tented area creating means comprises means for detachably affixing a third area of fabric generally along a central section of the central portion top edge to:

a fourth area of fabric along the central portion top edge between the third area of fabric and the outer side edge; and a fifth area of fabric along the central portion top edge between the third area of fabric and the inner side edge.

5. The nursing cover recited in claim 4, wherein the detachably affixing means comprises:

a first section of hook-and-loop-type fastener affixed to the third area of fabric;

a second section of hook-and-loop-type fastener affixed to the fourth area of fabric; and another second section of hook-and-loop-type fastener affixed to the fifth area of fabric, the two second sections of hook-and-loop-type fastener matable with the first section of hook-and-loop-type fastener.

6. The nursing cover recited in claim 1, wherein the front portion and the rear portion comprise a soft fabric for minimizing irritation to the baby and the mother.

7. The nursing cover recited in claim 1, mesh fabric of the central portion further has sufficient openness of weave to permit the baby to be viewed from a distance corresponding to a distance between a head of the mother and the nursing baby.

8. A nursing cover comprising:

a fabric panel having:

a front portion for draping over a nursing baby and over a front of a nursing mother;

a rear portion for draping over a shoulder and down a back of the nursing mother, the rear portion having an outer side edge corresponding to a nursing side of the mother and a generally opposed inner side edge; and a generally central portion having a bottom edge connected to the front portion and a top edge connected to the rear portion, the central portion comprising a mesh fabric having sufficient opacity to obscure the baby from a view of a bystander but having sufficient openness of weave to permit ventilation for the baby, the central portion further having a length defined by a distance between the bottom edge and the top edge, an outer side edge along a same side as the rear portion outer side edge, and an inner side edge generally opposed to the outer side edge;

means for detachably affixing together a first area of fabric adjacent the outer side edge of the central portion to a second area of fabric adjacent the outer side edge of the rear portion, for providing additional privacy for the baby and the mother along the nursing side of the mother; and means for detachably affixing together a sixth area of fabric adjacent the inner side edge of the central portion to a seventh area of fabric adjacent the inner side edge of the rear portion, for providing additional privacy for the baby and the mother when the mother wishes to change the nursing side.

9. A dual-purpose nursing and stroller cover comprising:

a fabric panel having:

a front portion;

a rear portion having an outer side edge and a generally opposed inner side edge; and a generally central portion having a bottom edge connected to the front portion and a top edge connected to the rear portion, the central portion comprising a mesh fabric having sufficient opacity to obscure a baby from a view of a bystander but having sufficient openness of weave to permit ventilation for the baby, the central portion further having a length defined by a distance between the bottom edge and the top edge, an outer side edge along a same side as the rear portion outer side edge, and an inner side edge generally opposed to the outer side edge;

means for detachably affixing together a first area of fabric adjacent the outer side edge of the central portion to a second area of fabric adjacent the outer side edge of the rear portion, for providing additional privacy for the baby and the mother along a nursing side of the mother when being used as a nursing cover and for creating a first side of a sleeve for draping over a stroller brace when being used as a stroller cover; and means for detachably affixing together a sixth area of fabric adjacent the inner side edge of the central portion to a seventh area of fabric adjacent the inner side edge of the rear portion, for providing additional privacy for the baby and the mother when the mother wishes to change the nursing side when being used as a nursing cover and for creating a second side of the sleeve for draping over a stroller brace when being used as a stroller cover.

* * * * *